US009982432B1

(12) United States Patent
Connell

(10) Patent No.: US 9,982,432 B1
(45) Date of Patent: May 29, 2018

(54) CURB WALL FORMING APPARATUS AND METHOD OF FORMING A CURB WALL

(71) Applicant: Illinois Tool Works Inc., Glenview, IL (US)

(72) Inventor: Robert U. Connell, Melbourne (AU)

(73) Assignee: Illinois Tool Works Inc., Glenview, IL (US)

( * ) Notice: Subject to any disclaimer, the term of this patent is extended or adjusted under 35 U.S.C. 154(b) by 0 days. days.

(21) Appl. No.: 15/881,253

(22) Filed: Jan. 26, 2018

Related U.S. Application Data

(63) Continuation of application No. 15/289,375, filed on Oct. 10, 2016, now Pat. No. 9,879,422.
(Continued)

(51) Int. Cl.
*E04B 2/86* (2006.01)
*E04F 19/02* (2006.01)
(Continued)

(52) U.S. Cl.
CPC ..... *E04B 2/8635* (2013.01); *E04F 19/026* (2013.01); *E04G 13/00* (2013.01);
(Continued)

(58) Field of Classification Search
CPC ..... E04B 2/8635; E04B 2002/867; E04B 2103/02; E04G 13/00; E04G 17/001;
(Continued)

(56) References Cited

U.S. PATENT DOCUMENTS 2,180,842 A * 11/1939 Winding ..... E01C 19/506 249/155
2,250,839 A 7/1941 Perry
(Continued)

FOREIGN PATENT DOCUMENTS

| | | |
|---|---|---|
| DE | 202007007573 | 8/2007 |
| WO | WO 2009/049042 | 4/2009 |
| WO | WO 2013/076500 | 5/2013 |

OTHER PUBLICATIONS

International Search Report and Written Opinion for International Application No. PCT/US2016/056336, dated Dec. 7, 2016 (12 pages).

*Primary Examiner* — Jeanette E Chapman
(74) *Attorney, Agent, or Firm* — Neal, Gerber & Eisenberg LLP

(57) ABSTRACT

Various embodiments of the present disclosure provide a curb wall forming apparatus and method for forming a curb wall without causing damage to the adjacent concrete floor. In various embodiments, the curb wall forming apparatus includes one or more floor plates, one or more curb side wall forming panel supports, one or more stanchions, one or more end plates, one or more wall attachment plates, and one or more curb side wall forming panels which are used together to enable a curb wall to be formed. These components can be used together to enable a curb wall to be formed on a floor adjacent to an upstanding wall without causing damage to the wall or the area of the floor adjacent to the formed curb wall. The floor plates, the curb side wall forming panel supports, the stanchions, the end plates, and the wall attachment plates remain as part of the formed curb wall.

9 Claims, 18 Drawing Sheets

Related U.S. Application Data

(60) Provisional application No. 62/241,404, filed on Oct. 14, 2015.

(51) Int. Cl.
*E04G 17/14* (2006.01)
*E04G 17/00* (2006.01)
*E04G 13/00* (2006.01)
*E04F 19/04* (2006.01)

(52) U.S. Cl.
CPC ..... *E04G 17/001* (2013.01); *E04G 17/14* (2013.01); *E04B 2002/867* (2013.01); *E04B 2103/02* (2013.01); *E04F 19/028* (2013.01); *E04F 2019/0418* (2013.01)

(58) Field of Classification Search
CPC ..... E04G 17/14; E04F 19/026; E04F 19/028; E04F 2019/0418
See application file for complete search history.

(56) References Cited

U.S. PATENT DOCUMENTS 2,369,000 A 2/1945 Page
2,436,593 A 2/1948 Moselowitz
2,611,944 A * 9/1952 Bailey ..... E04B 5/29 264/33
2,663,925 A * 12/1953 Yates ..... E01C 19/502 249/6
2,809,414 A * 10/1957 Mitchell ..... E01C 19/506 249/2
3,385,552 A * 5/1968 Von Drasek ..... B28B 7/06 249/4
3,389,646 A * 6/1968 Ruggles ..... E01C 19/506 249/5
3,395,884 A * 8/1968 Laukala ..... E01C 19/506 249/216
3,461,639 A * 8/1969 Merrill ..... E02D 27/02 52/742.14
3,618,181 A * 11/1971 Veale ..... B28B 7/0088 249/117
3,733,141 A 5/1973 James, III
4,005,582 A * 2/1977 Tamaro ..... E02D 5/20 405/267
4,013,375 A 3/1977 Heaton
4,055,927 A * 11/1977 Tamaro ..... E02D 5/20 264/35
4,056,154 A * 11/1977 Tamaro ..... E02D 5/20 175/416
4,152,382 A 5/1979 Catenacci
4,428,166 A 1/1984 Burghart
4,494,725 A * 1/1985 Sims ..... E04G 17/12 249/2
4,637,585 A 1/1987 Picollo
4,824,068 A * 4/1989 Ferland ..... E01C 19/506 249/157
5,152,382 A * 10/1992 Hoch ..... F16H 9/14 180/336
5,156,753 A * 10/1992 Speidel ..... B28B 7/02 249/159
5,174,083 A 12/1992 Mussell
5,354,189 A 10/1994 McKinnon
5,720,467 A 2/1998 Del Zotto
5,772,357 A 6/1998 Evans
6,508,606 B1 1/2003 James, III et al.
6,695,525 B2 * 2/2004 Hirschhorn ..... E01C 19/506 404/7
6,752,370 B2 6/2004 Gonzales
6,775,952 B2 8/2004 Boxall et al.
6,797,159 B2 9/2004 Hatton
6,874,288 B1 * 4/2005 Washa ..... E04B 1/4157 52/371
7,172,364 B1 * 2/2007 Nicholson ..... E01C 19/4893 404/105
7,182,309 B1 * 2/2007 Olsen ..... E01C 19/506 249/2
7,493,736 B2 2/2009 Sanders
8,302,359 B2 11/2012 Boxall et al.
8,303,210 B2 11/2012 Parkes et al.
8,322,087 B1 12/2012 Lascano
8,573,886 B1 11/2013 Taylor, Jr.
9,169,643 B2 10/2015 Dryburgh et al.
9,578,812 B2 2/2017 Moita
2002/0157325 A1 10/2002 Domanico
2007/0062144 A1 3/2007 Moon
2012/0009014 A1 1/2012 Weber
2012/0155960 A1 * 6/2012 Lowery ..... E01C 19/502 404/72
2014/0157704 A1 * 6/2014 McDonagh ..... E04G 11/062 52/426
2015/0167328 A1 6/2015 Parkes et al.
2015/0258709 A1 * 9/2015 Urbina ..... E01C 19/506 404/72
2016/0060818 A1 * 3/2016 Campbell ..... E01C 11/223 138/109
2017/0339836 A1 * 11/2017 Shelton ..... A01G 9/28

* cited by examiner

CURB WALL FORMING APPARATUS AND METHOD OF FORMING A CURB WALL

PRIORITY CLAIM

This application is a continuation application of, and claims priority to and the benefit of U.S. patent application Ser. No. 15/289,375, filed on Oct. 10, 2016, which claims priority to and the benefit of U.S. Provisional Patent Application No. 62/241,404, filed Oct. 14, 2015, the entire contents of each of which are incorporated herein by reference.

BACKGROUND

Curbs and curb walls are well known and have been widely used in the construction industry, the concrete flooring industry, and other industries for many years. In various buildings, curb walls are positioned adjacent to walls to protect the walls from damage by vehicles (such as fork lift trucks). In one such example, curb walls are widely used in buildings that provide cold storage to protect the buildings' insulated walls that provide the cold storage.

FIG. 1 generally illustrates a part of a structure which has an upstanding insulated wall 20 and a concrete floor 40 positioned on a sub-grade 50 adjacent to the insulated wall 20 (after the concrete is poured adjacent to the insulated wall). The concrete floor 50 and the insulated wall 20 form or define part of a cold storage area 30. The problem with this configuration is that a vehicle (not shown) in the cold storage area 30 of the structure may hit or engage the insulated wall 20 and damage the insulated wall 20. To prevent this, builders have built curb walls such as curb wall 60 adjacent to the insulated wall 20 as generally shown in FIG. 2. The curb wall 60 generally protects the insulated wall 20 against damage by vehicles (such as fork lift trucks). However, the known methods and apparatus for building or installing such curb walls have several disadvantages.

One disadvantage with the known methods and apparatus for building or installing such curb walls is that such methods and apparatus result in the newly poured concrete floor 40 being damaged. For example, the known forms (not shown) used to form such curb walls need to be supported by the concrete floor 40 adjacent to the curb wall 60. This requires these forms to be attached to the newly poured concrete floor 40 which causes holes to be made in the newly poured concrete floor 40 to support such forms. When such forms are subsequently removed after the curb wall 60 is poured and hardened, the holes are left in the newly poured concrete floor 40 adjacent to the curb wall 60. These holes weaken the new concrete floor 40. These holes are typically patched, which adds to the expense and time needed to build these structures and specifically the curb walls of these structures. The known forms used to form such curb walls (if not reused) are typically discarded, which creates extra waste in landfills. This also creates additional expense in disposing of this extra waste.

Another disadvantage with the known methods and apparatus for building or installing such curb walls is that such methods and apparatus require a substantial amount of labor to install the known forms before the curb wall is poured, to remove the known forms after the curb is poured, and in finishing the curb wall after it is poured.

Another disadvantage with the known methods and apparatus for building or installing such curb walls is that such methods and apparatus require relatively costly forms, some of which cannot be reused, or be reused more than a limited number of times.

Accordingly, there is a need for an apparatus and method which solves the above problems.

SUMMARY

Various embodiments of the present disclosure provide a curb wall forming apparatus and a method for forming a curb wall form which solve the above problems and which provides a higher quality curb wall which minimizes post forming finishing.

In various embodiments, the curb wall forming apparatus of the present disclosure generally includes one or more floor plates, one or more curb side wall forming panel supports, one or more stanchions, one or more end plates, one or more wall attachment plates, and one or more curb side wall forming panels. These components operate together to enable a curb wall to be formed on a floor adjacent to an upstanding wall without causing damage to the wall or to the area of the floor adjacent to the formed curb wall. In various embodiments, the floor plates, the curb side wall forming panel supports, the stanchions, the end plates, and the wall attachment plates remain as part of the formed curb wall, and thus substantially reduce waste. In various embodiments, the curb side wall forming panels are removed after the concrete curb wall dries and hardens, and thus does not form part of the remaining curb wall. These curb side wall forming panels can be reused to further reduce waste Additional features and advantages of the present invention are described in, and will be apparent from, the following Detailed Description and the Figures.

DETAILED DESCRIPTION OF EXAMPLE EMBODIMENTS

Various embodiments of the present disclosure provide a curb wall forming apparatus and a method of forming a curb wall which solve the above problems. The curb wall forming apparatus of the present disclosure is sometimes referred to herein for brevity as the forming apparatus or the apparatus.

Figure 4:
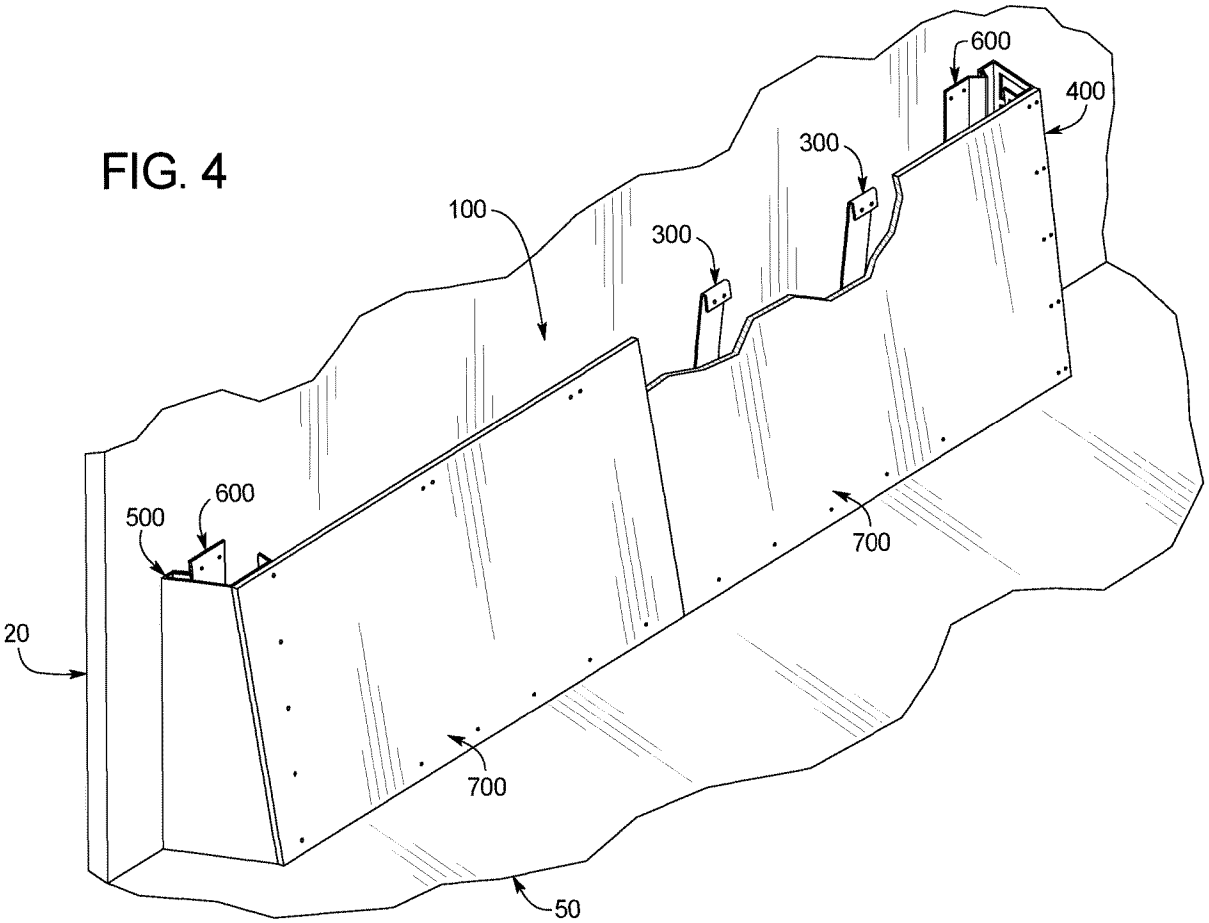
FIG. 4 is a perspective view of the curb wall forming apparatus of FIG. 3 shown positioned on the concrete floor (shown in fragmentary), shown positioned adjacent to the insulated wall (shown in fragmentary), shown with the curb side wall forming panels (with one panel partially broken away), and shown prior to the concrete of the curb wall being poured.
Figure 5:
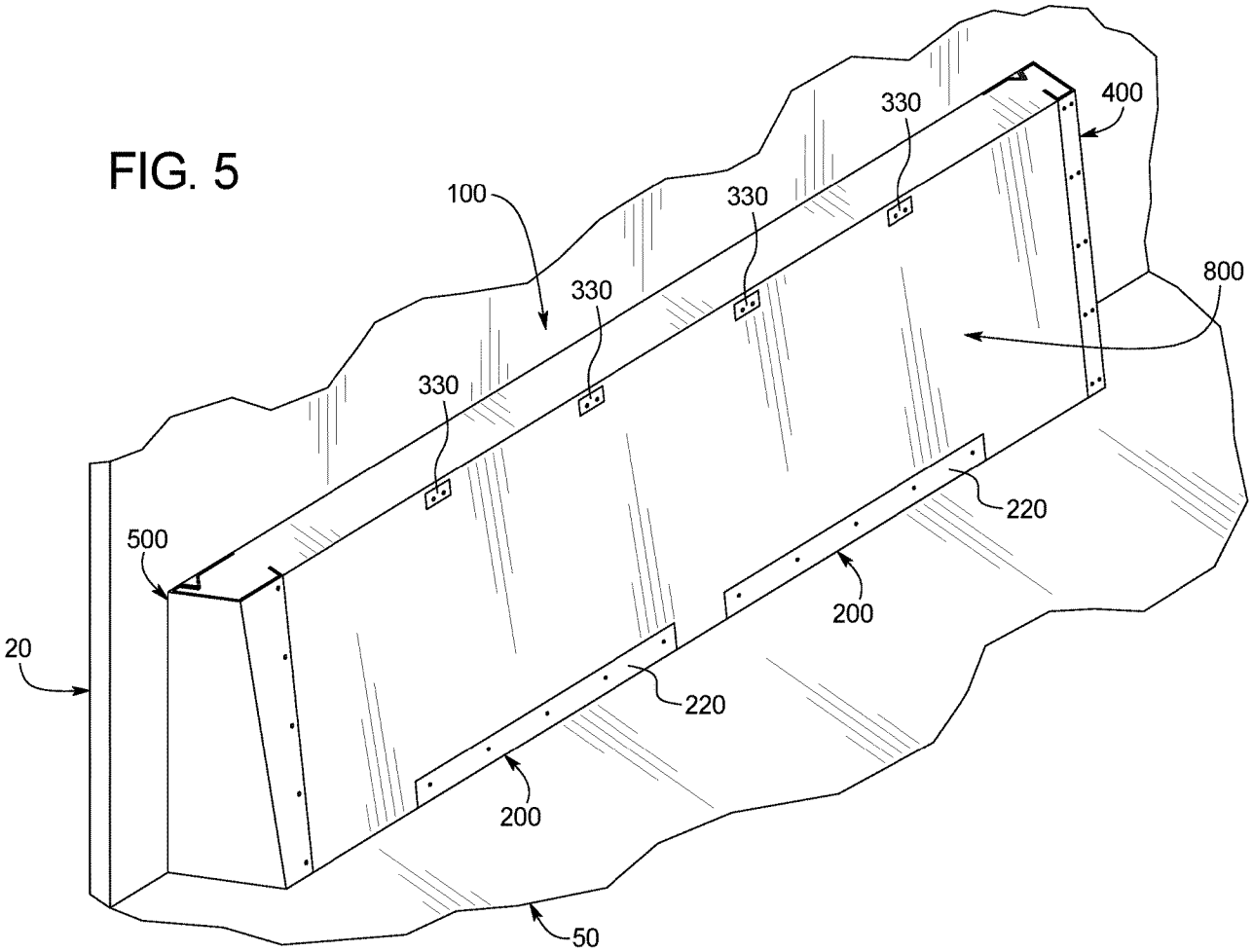
FIG. 5 is a perspective view of the formed curb wall after the concrete of the curb wall is poured and hardened, and after the curb side wall forming panels have been removed. Various components of the curb wall forming apparatus of FIG. 3 are positioned at least partially in the formed curb wall with no exposed edges.

Referring now to FIGS. 3, 4, 5, 6, 7, 8, 9, 10, 11, 12, 13, 14, 15, 16, 17, 18, 19, and 20, one example embodiment of the curb wall forming apparatus of the present disclosure is illustrated and generally indicated by numeral 100. In various embodiments, the curb wall forming apparatus 100 generally includes or employs: (1) one or more floor plates 200; (2) one or more curb side wall forming panel supports 300; (3) one or more stanchions 400; (4) one or more end plates 500; (5) one or more wall attachment or locking plates 600; and (6) one or more curb side wall forming panels 700. These components operate together as further described herein to enable a curb wall 800 to be formed on a floor, such as concrete floor 50, adjacent to an upstanding wall, such as insulated wall 20, without causing damage to the wall or the area of the concrete floor adjacent to the formed curb wall. It should be appreciated that in various alternative embodiments or configurations, more than one of these components may be employed and one or more of these components may not be employed. In this illustrated embodiment, the floor plates 200, the curb side wall forming panel supports 300, the stanchions 400, the end plates 500, and the wall attachment or locking plates 600 remain as part of the formed curb wall 800, as best shown in FIG. 5, and thus substantially reduce waste. In this illustrated embodiment, the curb side wall forming panels 700 are removed after the concrete that forms the curb wall 800 dries and hardens, and thus do not form part of the curb wall 800. The curb wall forming panels 700 can be reused to further reduce waste.

Figure 7:
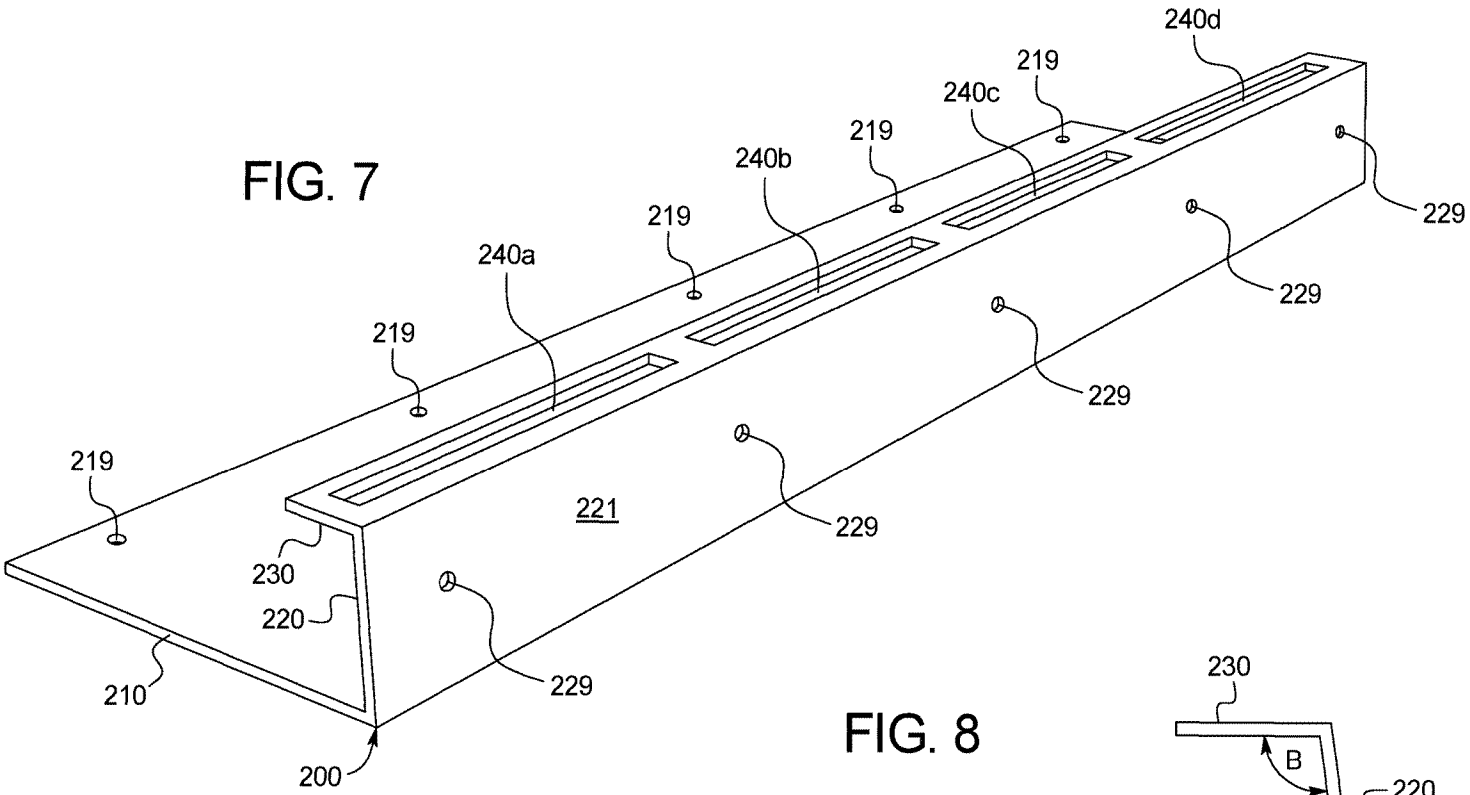
FIG. 7 is an enlarged front perspective view of the floor plate of the curb wall forming apparatus of FIG. 3.
Figure 8:
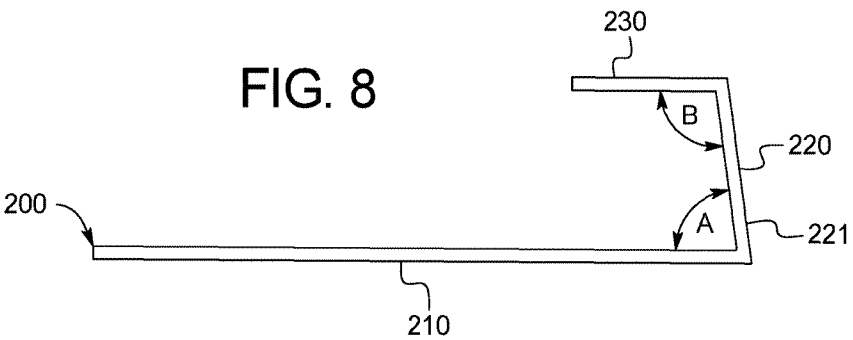
FIG. 8 is an enlarged end view of the floor plate of the curb wall forming apparatus of FIG. 3.
Figure 9:
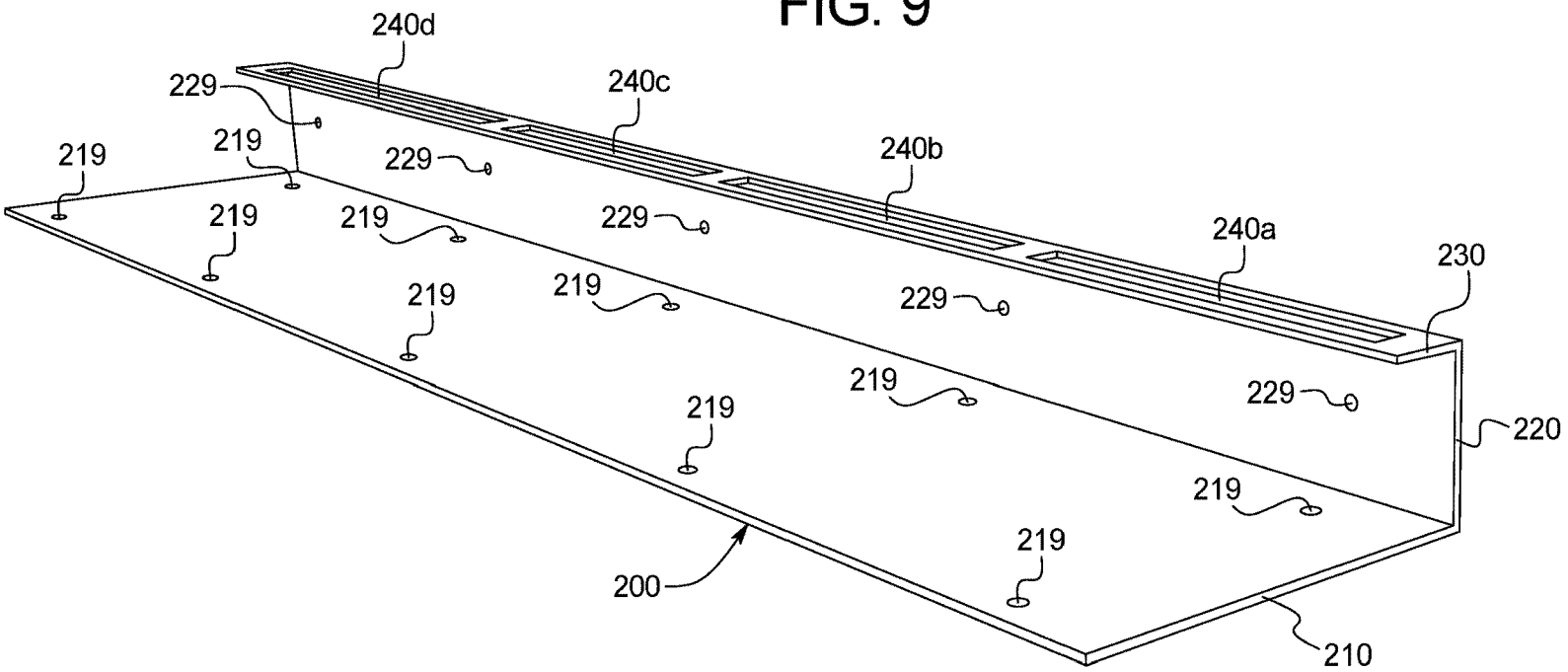
FIG. 9 is an enlarged rear perspective view of the floor plate of the curb wall forming apparatus of FIG. 3.

More specifically, in this illustrated example embodiment, the floor plate 200 generally includes an elongated floor plate base or floor base plate 210 positionable on the concrete floor 50, an elongated curb side wall forming panel attachment plate 220 connected to and extending upwardly from the base plate 210, and an elongated locking lip 230 connected to and extending inwardly from the curb side wall forming panel attachment plate 220 as best seen in FIGS. 7, 8, and 9. The floor base plate 210 includes or defines therethrough a plurality of openings or holes 219 which enable suitable fasteners (not shown) to be used to attach the floor plate 200 to the concrete floor 50 prior to the pouring of the concrete that forms the curb wall 800. The curb side wall forming panel attachment plate 220 includes or defines therethrough a plurality of openings or holes 229 which enable fasteners to be used to attach the curb side wall forming panel 700 to the floor plate 200 prior to the pouring of the concrete that forms the curb wall 800. The curb side wall forming panel attachment plate 220 extends at an acute angle A from the floor base plate 220 in this illustrated embodiment. The locking lip 230 extends at an obtuse angle B from the curb side wall forming panel attachment plate 220 in this illustrated embodiment. This configuration enables the curb wall forming panel 700 to be positioned against and attached to the outer surface 221 of the curb side wall forming panel attachment plate 220 at a suitable angle as generally shown in FIG. 4. The locking lip 230 includes or defines therethrough a plurality of spaced apart slots 240*a*, 240*b*, 240*c*, and 240*d*. The slots 240*a*, 240*b*, 240*c*, and 240*d* enable the poured concrete which forms the curb wall 800 to extend though the locking lip 230 to partially lock the floor plate 200 to the curb wall 800 when the concrete that forms the curb wall 800 dries and hardens.

Figure 1:
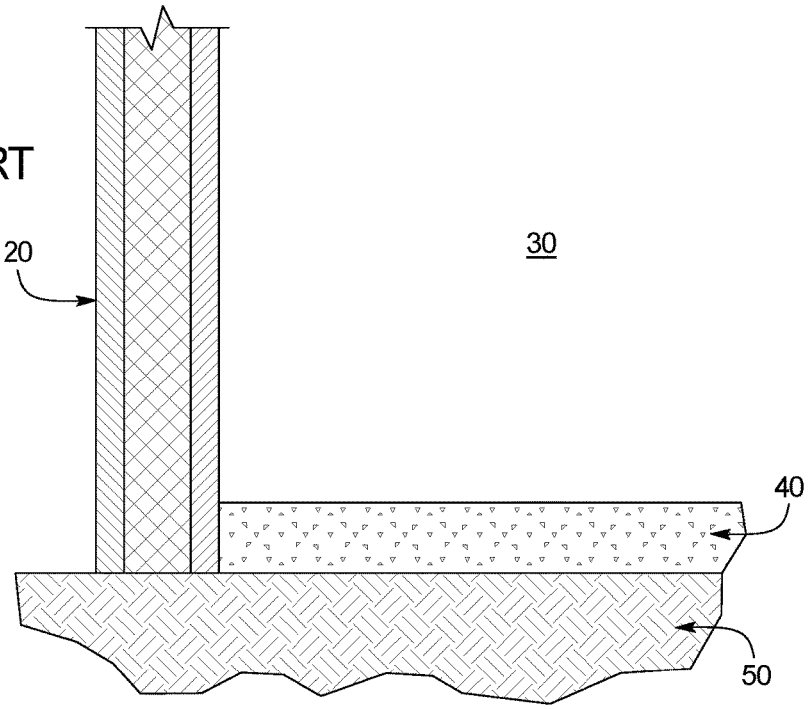
FIG. 1 PRIOR ART
FIG. 1 is a side cross-sectional elevational view of an insulated wall and a concrete floor adjacent to the insulated wall.
Figure 2:
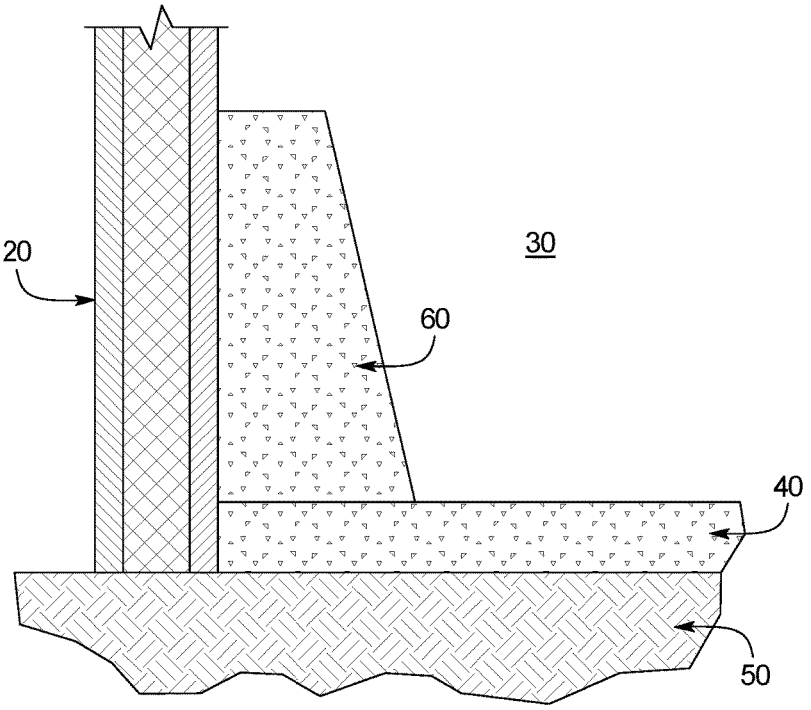
FIG. 2 is a side cross-sectional elevational view of an insulated wall, a concrete floor adjacent to the insulated wall, and a curb wall formed on the concrete floor adjacent to the insulated wall.
Figure 3:
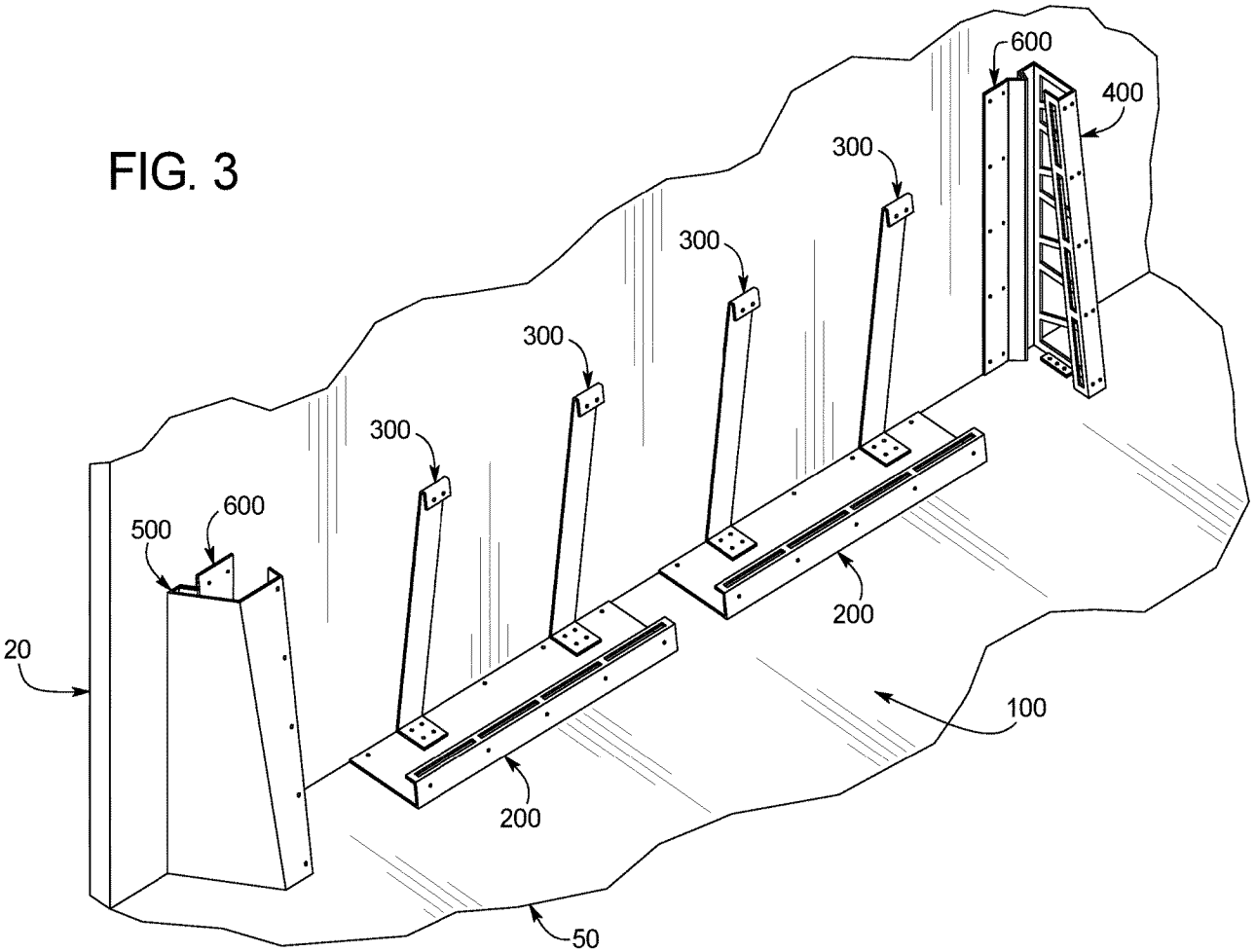
FIG. 3 is a perspective view of a curb wall forming apparatus of one embodiment of the present disclosure shown positioned on a concrete floor (shown in fragmentary), shown positioned adjacent to an insulated wall (shown in fragmentary), shown without the curb side wall forming panels, and shown prior to the concrete of the curb wall being poured.
Figure 6:
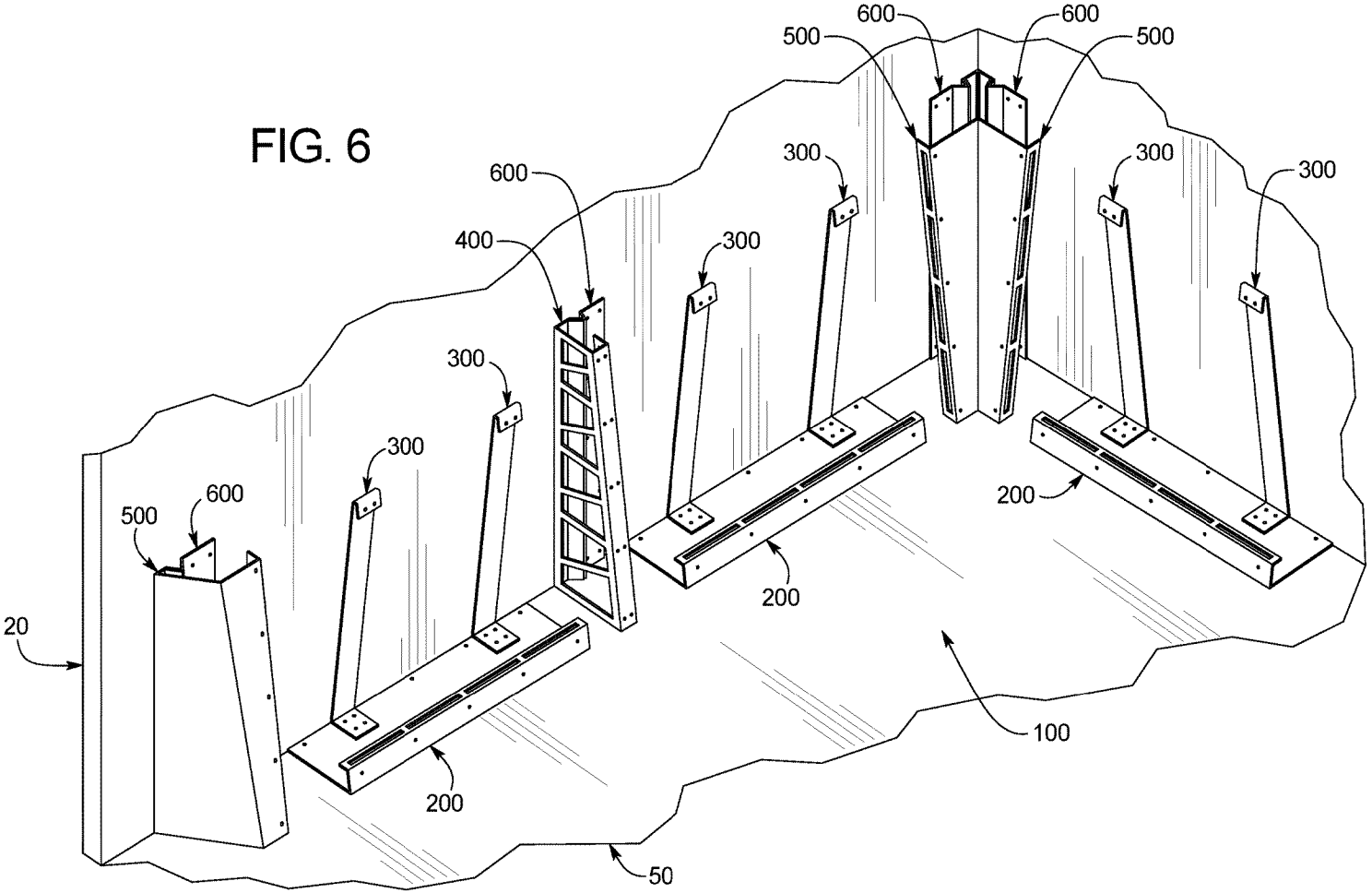
FIG. 6 is a perspective view of the curb wall forming apparatus of FIG. 3 shown positioned on a concrete floor (shown in fragmentary), shown positioned adjacent to adjoining insulated walls (shown in fragmentary), shown without the curb side wall forming panels, and shown prior to the concrete of the curb wall being poured.

In this illustrated example embodiment, each of the floor plates 200 is attachable to the concrete floor 50 such that the floor base plate 210 abuts the insulated wall 20 and the curb side wall forming panel attachment plate 220 is spaced apart from the insulated wall 20 as best shown in FIGS. 3 and 6. In this illustrated example, the floor plates 200 are positioned parallel or substantially parallel with the insulated wall 20. It should also be appreciated from FIG. 6 that multiple floor plates 200 can be employed with respect to adjacent walls. It should also be appreciated from FIGS. 4 and 6 that the arrangement of the stanchions 400 and the end plates 500 may vary based on the desired configuration and length of the curb wall.

It should be appreciated that multiple floor plates 200 can be used together to form the curb wall(s) and that the quantity of floor plates used will at least in part depend on the length of each floor plate, the length of the wall(s), and the length of the desired curb wall(s). The floor plates are each made from a metal such as aluminum or steel in this example embodiment. The floor base plate 210, the curb side wall forming panel attachment plate 220, and the locking lip 230 are integrally formed from a single sheet of metal in this illustrated embodiment. It should also be appreciated that two or more of these parts can be separately formed and suitably connected. It should be appreciated that the floor plates can be made from other suitable materials in accordance with the present disclosure. It should also be appreciated that the floor plates can be made having other suitable shapes and sizes in accordance with the present disclosure.

It should be appreciated that the holes and the slots in the floor plate 200 can be stamped out, drilled out, or otherwise suitably formed.

Figure 10:
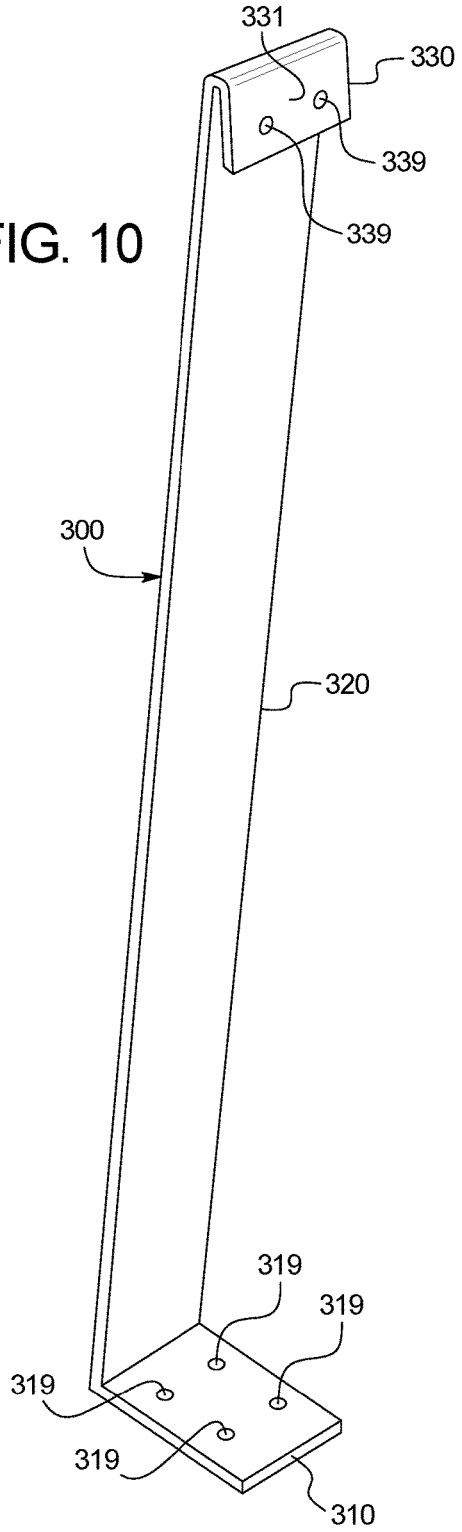
FIG. 10 is an enlarged front perspective view of the curb side wall forming panel support of the curb wall forming apparatus of FIG. 3.
Figure 11:
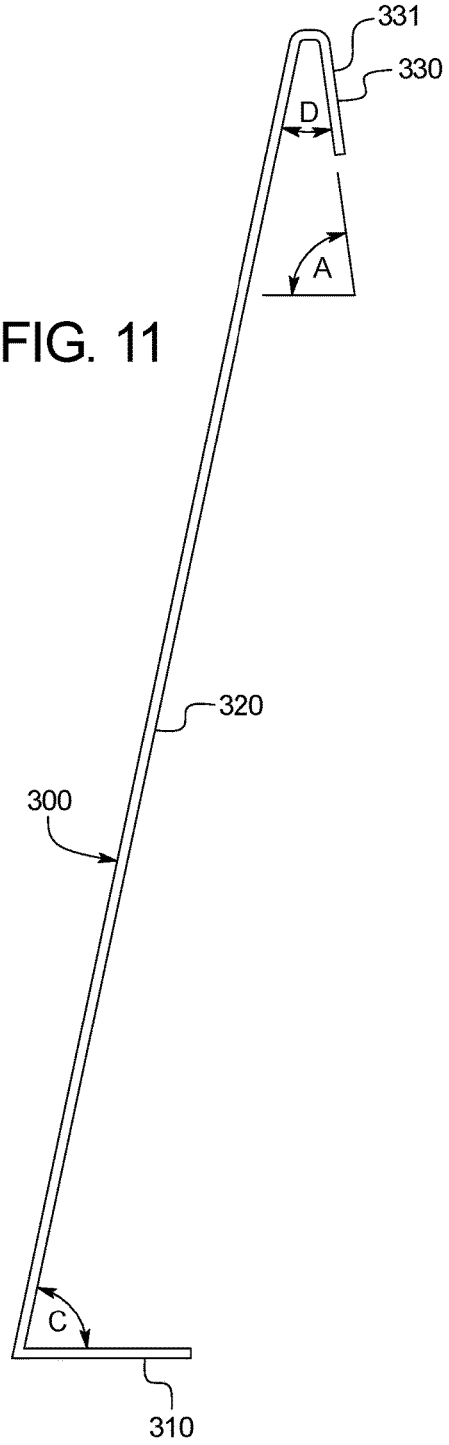
FIG. 11 is an enlarged end view of the curb side wall forming panel support of the curb wall forming apparatus of FIG. 3.
Figure 12:
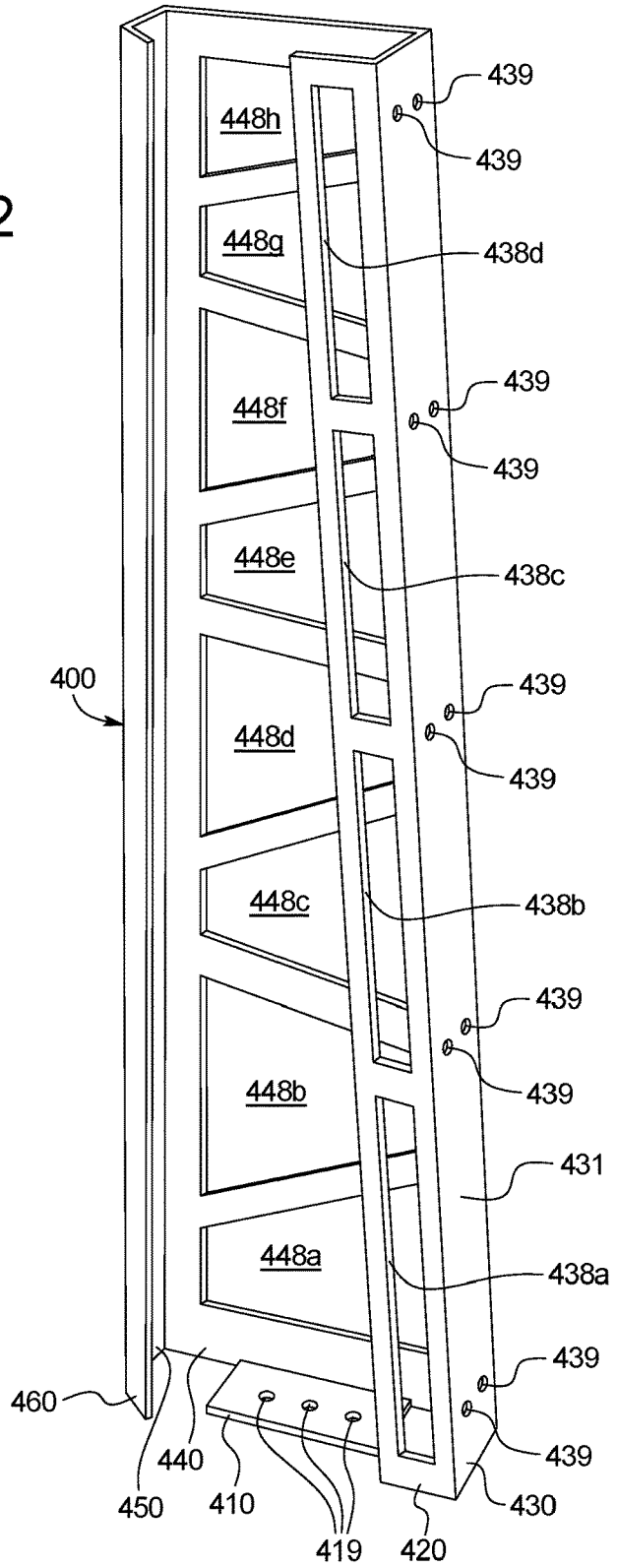
FIG. 12 is an enlarged front perspective view of the stanchion of the curb wall forming apparatus of FIG. 3.
Figure 13:
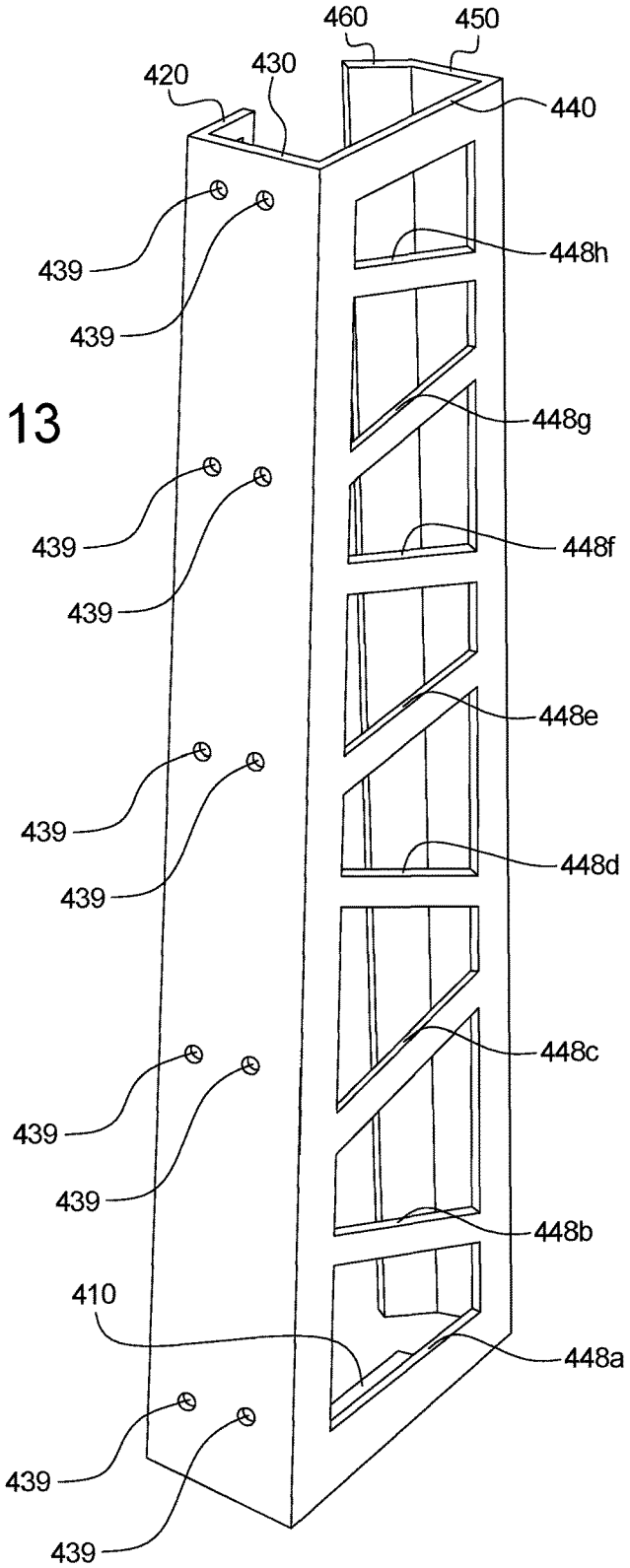
FIG. 13 is an enlarged rear perspective view of the stanchion of the curb wall forming apparatus of FIG. 3.

In this illustrated example embodiment, the curb side wall forming panel support 300 includes an attachment plate 310 positionable on and attachable to the floor base plate 210 of the floor plate 200, a riser or riser plate 320 connected to and extending upwardly from the attachment plate 310, and a curb side wall forming panel attachment plate 330 connected to and extending from downwardly from the top of the riser plate 320 as best shown in FIGS. 10 and 11. The attachment plate 310 includes or defines therethrough a plurality of openings or holes 319 which enable suitable fasteners (not shown) to be used to attach the attachment plate 310 to the floor base plate 210 of the floor plate 200 as generally shown in FIGS. 3 and 6 prior to the pouring of the concrete curb wall 800. The riser plate 320 extends upwardly at an acute angle C from the attachment plate 310 and the curb side wall forming panel attachment plate 330 extends downwardly from the riser plate 320 at an acute angle D such that the outer surface 331 of the curb side wall forming panel attachment plate 330 extends in a same angled plane as the outer surface 221 of the curb side wall forming panel attachment plate 220 of the floor plate 200. This enables the curb side wall forming panel 700 to be attached to the curb side wall forming panel attachment plate 330 of the curb side wall forming panel support 300 and to the curb side wall forming panel attachment plate 220 of the floor plate 200 as generally shown in FIG. 4. It should be appreciated that angle A in FIG. 11 is the same angle as angle A in FIG. 8 in this illustrated embodiment. The curb side wall forming panel attachment plate 330 includes or defines therethrough a plurality of openings or holes 339 which enable fasteners (not shown) to be used to attach the curb side wall forming panel 700 to the curb side wall forming panel attachment plate 330 prior to the pouring of the concrete curb wall 800.

It should be appreciated that multiple curb side wall forming panel supports 300 can be used together to form the curb wall and that the quantity of curb side wall forming panel supports used will at least in part depend on the length of each floor plate, the length of the wall(s), the length of the desired curb wall(s), and the height of the desired curb wall(s). The curb side wall forming panel supports are each made from a metal such as aluminum or steel in this example embodiment. The attachment plate 310, the riser plate body 320, and the curb side wall forming panel attachment plate 330 of the curb side wall forming panel support 300 are integrally formed from a single sheet of metal in this illustrated embodiment. It should also be appreciated that two or more of these parts can be separately formed and suitably connected. It should be appreciated that the curb side wall forming panel supports can be made from other suitable materials in accordance with the present disclosure. It should also be appreciated that the curb side wall forming panel supports can be made having other suitable shapes and sizes in accordance with the present disclosure. It should be appreciated that the holes in the curb side wall forming panel support 300 can be stamped out, drilled out, or otherwise suitably formed.

In this illustrated example embodiment, the stanchion 400 generally includes a stanchion base or stanchion base plate 410 and five upwardly extending connected elongated walls 420, 430, 440, 450, and 460 as best shown in FIGS. 12, 13, 14, and 15. The stanchion base plate 410 is positionable on and attachable to the concrete floor 50. The stanchion base plate 410 includes or defines therethrough a plurality of openings or holes 419 which enable suitable fasteners (not shown) to be used to attach the stanchion 400 to the concrete floor 50 prior to the pouring of the concrete that forms the curb wall 800.

The first wall 420 of the stanchion 400 includes or defines therethrough a plurality of spaced apart slots 428*a*, 428*b*, 428*c*, and 428*d* which enable the poured concrete which forms the curb wall 800 to extend though the wall 420 to partially lock the stanchion 400 in the curb wall 800 when the concrete that forms the curb wall 800 dries and hardens. The second wall or curb side wall forming panel attachment plate 430 includes or defines therethrough a plurality of spaced apart openings or holes 439 which enable suitable fasteners (not shown) to be used to attach the curb side wall forming panel 700 to the stanchion 400 prior to the pouring of the concrete that forms the curb wall 800.

Figure 14:
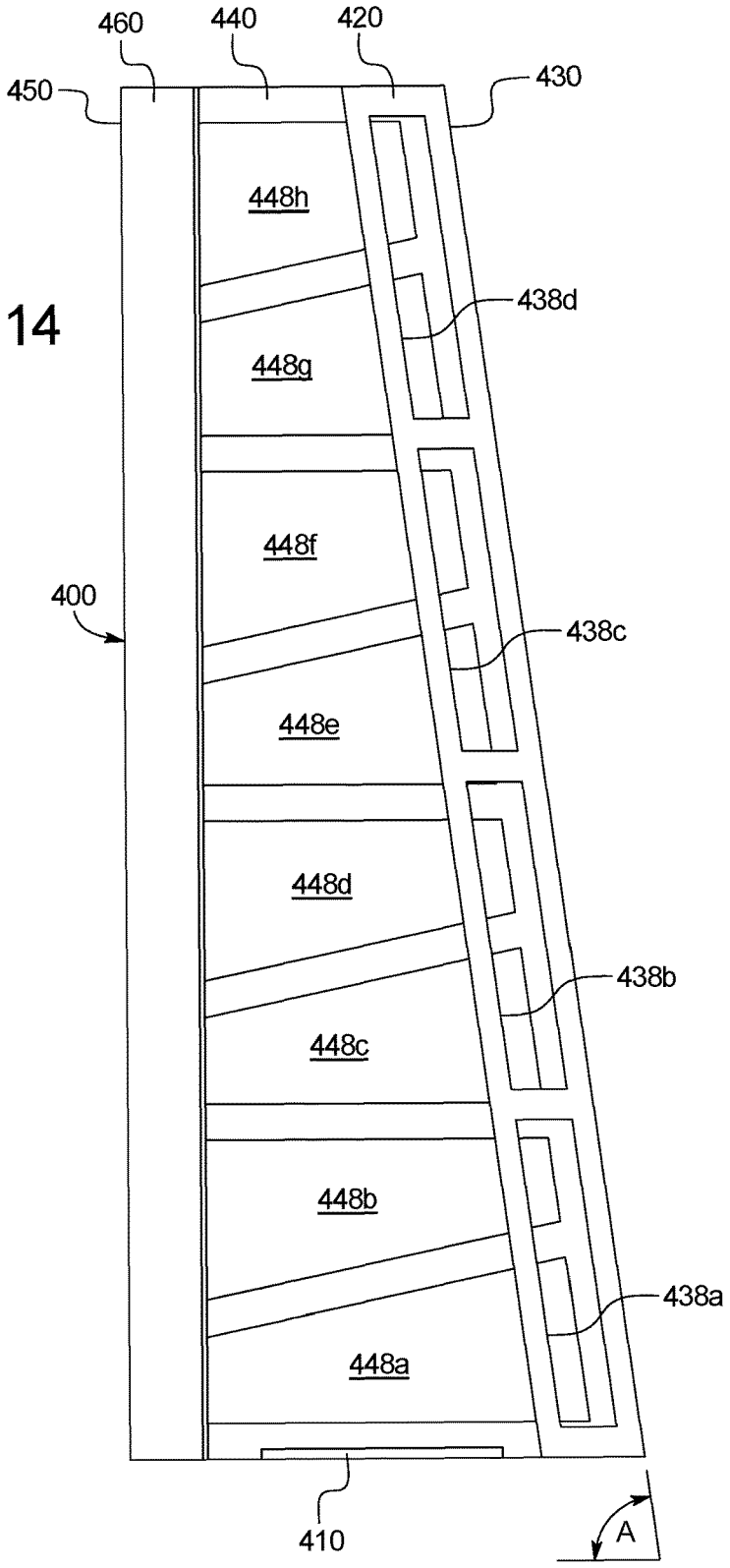
FIG. 14 is an enlarged side view of the stanchion of the curb wall forming apparatus of FIG. 3.
Figure 15:
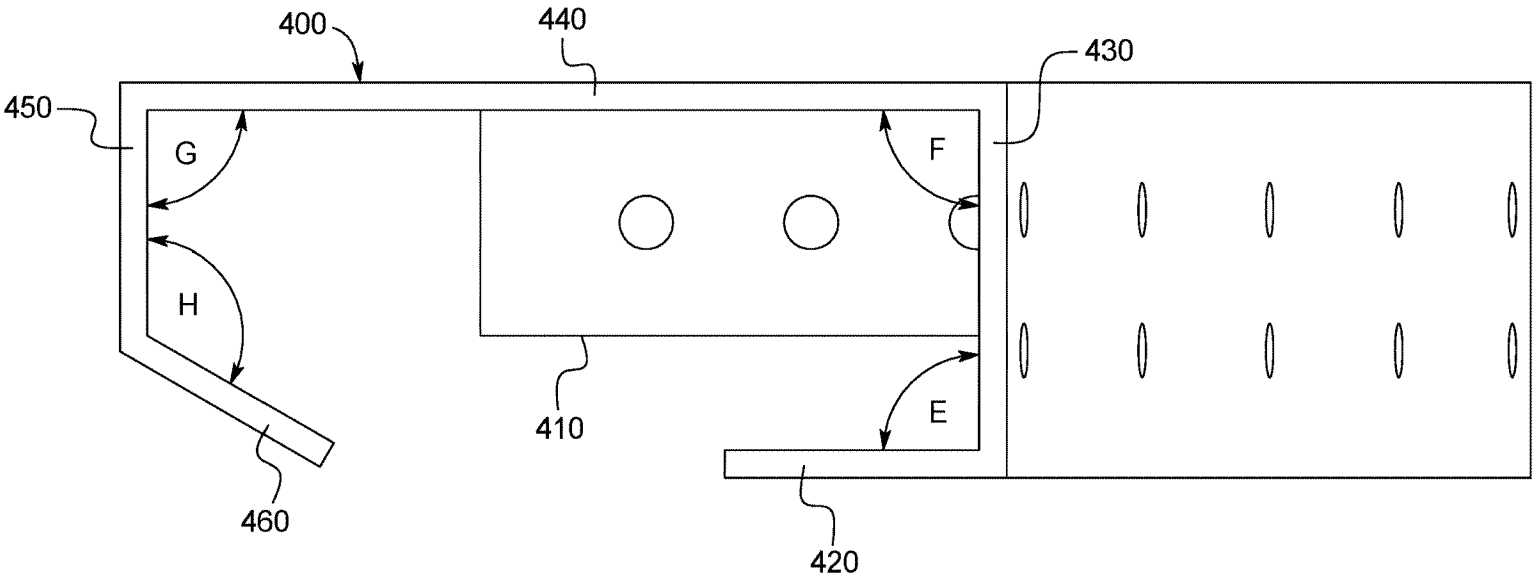
FIG. 15 is an enlarged top view of the stanchion of the curb wall forming apparatus of FIG. 3.
Figure 16:
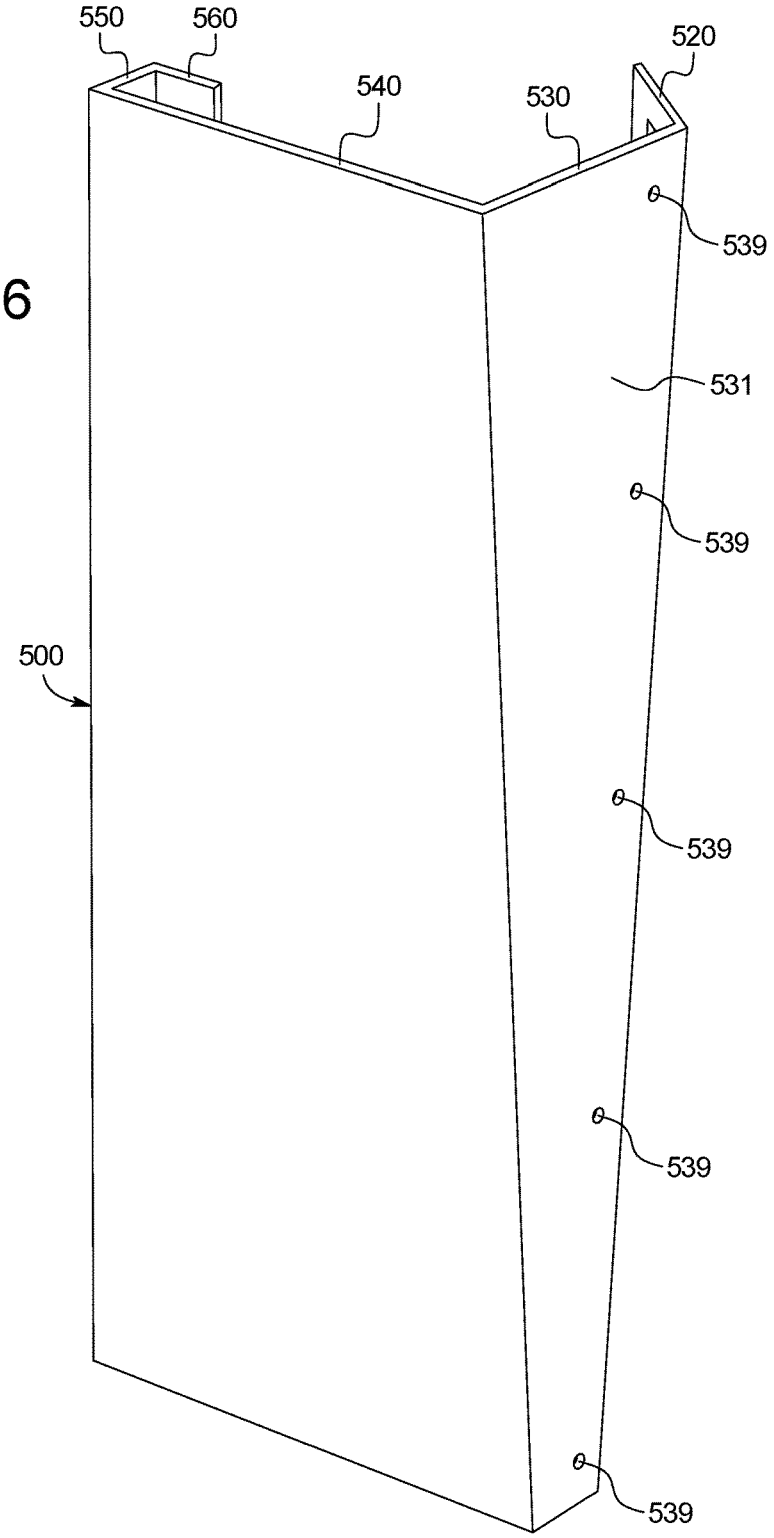
FIG. 16 is an enlarged front perspective view of the end wall of the curb wall forming apparatus of FIG. 3.
Figure 17:
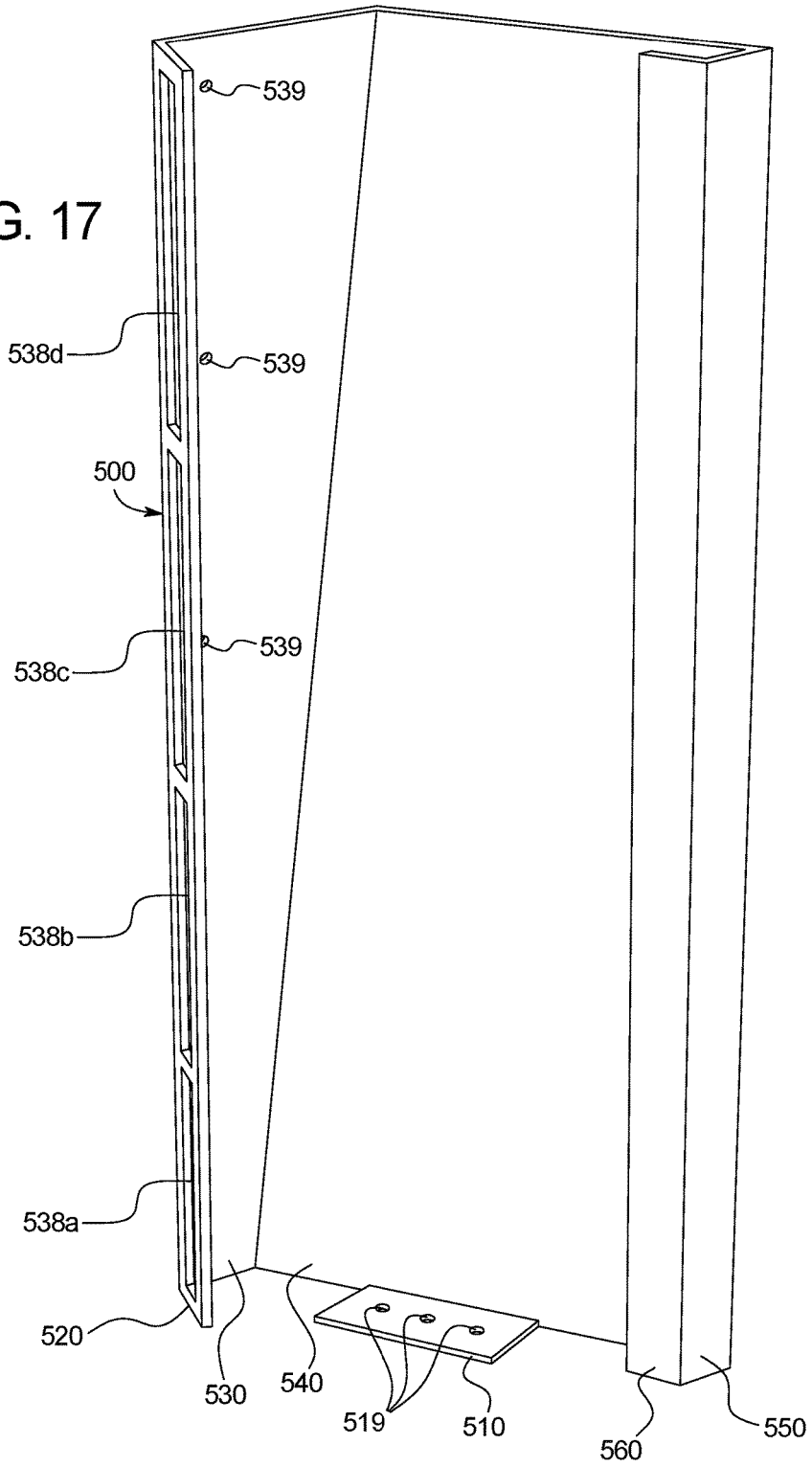
FIG. 17 is an enlarged rear perspective view of the end wall of the curb wall forming apparatus of FIG. 3.

The second wall or curb side wall forming panel attachment plate 430 of the stanchion 400 extends upwardly at an acute angle A from the plane in which the stanchion base plate 410 extends such that the outer surface 431 of second wall or curb side wall forming panel attachment plate 430 extends in a same angled plane as the outer surface 221 of the curb side wall forming panel attachment plate 220 of the floor plate 200 and the outer surface 331 of the curb side wall forming panel attachment plate 330 of the curb wall forming panel support 300. This enables the curb side wall forming panel 700 to be attached to the second wall or curb side wall forming panel attachment plate 430 of the stanchion as generally shown in FIG. 4. It should be appreciated that angle A in FIG. 14 is the same angle as angle A in FIG. 8 and angle A in FIG. 11 in this illustrated embodiment. The second wall or curb side wall forming panel attachment plate 430 of the stanchion 400 extends at an angle E from the first wall 420 in this illustrated embodiment.

The third wall 440 of the stanchion 400 includes or defines therethrough a plurality of spaced apart slots 448*a*, 448*b*, 448*c*, 448*d*, 448*e*, 448*f*, 448*g*, and 448*h* which enable the poured concrete which forms the curb wall 800 to extend though the wall 440 to partially lock the stanchion 400 in the curb wall 800 when the concrete dries and hardens. The stanchion 400 is positionable such that the third wall 440 extends substantially transverse to the wall 20. The base stanchion plate 410 is attached to the third wall 440 in this illustrated embodiment. The third wall 440 of the stanchion 400 extends at an angle F from the second wall or curb side wall forming panel attachment plate 430 in this illustrated embodiment. It should be appreciated that if multiple stanchions are employed to form the curb wall 800, rebar or other reinforcing members can be supported by and extend through the third wall 440 of the stanchion 400.

The stanchion 400 is positionable such that the fourth wall 450 extends against and substantially parallel to the upstanding wall 20. The fourth wall 450 of the stanchion 400 extends at a right angle G from the third wall 440 in this illustrated embodiment.

The fifth wall 460 of the stanchion 400 extends inwardly from the fourth wall 450. The fifth wall 460 of the stanchion 400 extends at an obtuse angle H from the fourth wall 440 in this illustrated embodiment. It should be appreciated that angle H could alternatively be a right angle or an acute angle in accordance with the present disclosure. The fifth wall 460 is engageable by the wall attachment or locking plate 600 as generally shown in FIGS. 3, 4, and 6 and as further discussed below.

It should be appreciated that multiple stanchions 400 can be used together to form the curb wall 800 and that the quantity of stanchions used at least in part depends on the length of the wall(s) and the length of the desired curb wall(s). The stanchions are each made from a metal such as aluminum or steel in this example embodiment. The stanchion base plate 410 and the five upwardly extending connected walls 420, 430, 440 450, and 460 are integrally formed from a single sheet of metal in this illustrated embodiment. It should also be appreciated that two or more of these parts can be separately formed and suitably connected. It should be appreciated that the stanchions can be made from other suitable materials in accordance with the present disclosure. It should also be appreciated that the stanchions can be made having other suitable shapes and sizes in accordance with the present disclosure. It should be appreciated that the holes and the slots in the stanchion 400 can be stamped out, drilled out, or otherwise suitably formed.

In this illustrated example embodiment, the end plate 500 generally includes a end plate base or end plate base plate 510 and five upwardly extending connected elongated walls 520, 530, 540 550, and 560 as generally shown in FIGS. 16, 17, 18, and 19. The end plate base plate 510 is positionable on the concrete floor 50. The end plate base plate 510 includes or defines therethrough a plurality of openings or holes 519 which enable suitable fasteners (not shown) to be used to attach the end plate 500 to the concrete floor 50 prior to the pouring of the concrete curb wall 800.

The first wall 520 of the end plate 500 includes or defines a plurality of spaced apart slots 528*a*, 528*b*, 528*c*, and 528*d* which enable the poured concrete which forms the curb wall 800 to extend though the wall 520 to partially lock the end plate 500 in the curb wall 800 when the concrete dries and hardens.

Figure 18:
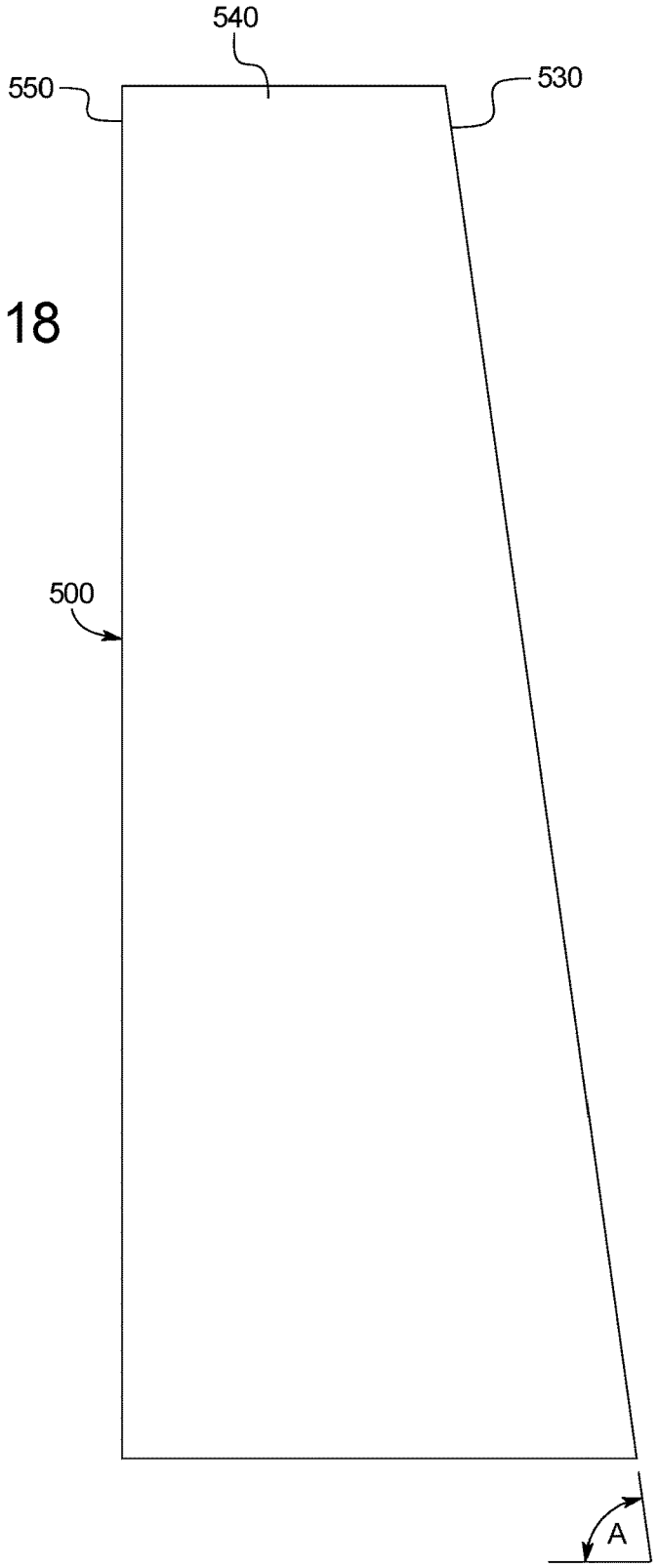
FIG. 18 is an enlarged side view of the end wall of the curb wall forming apparatus of FIG. 3.
Figure 19:
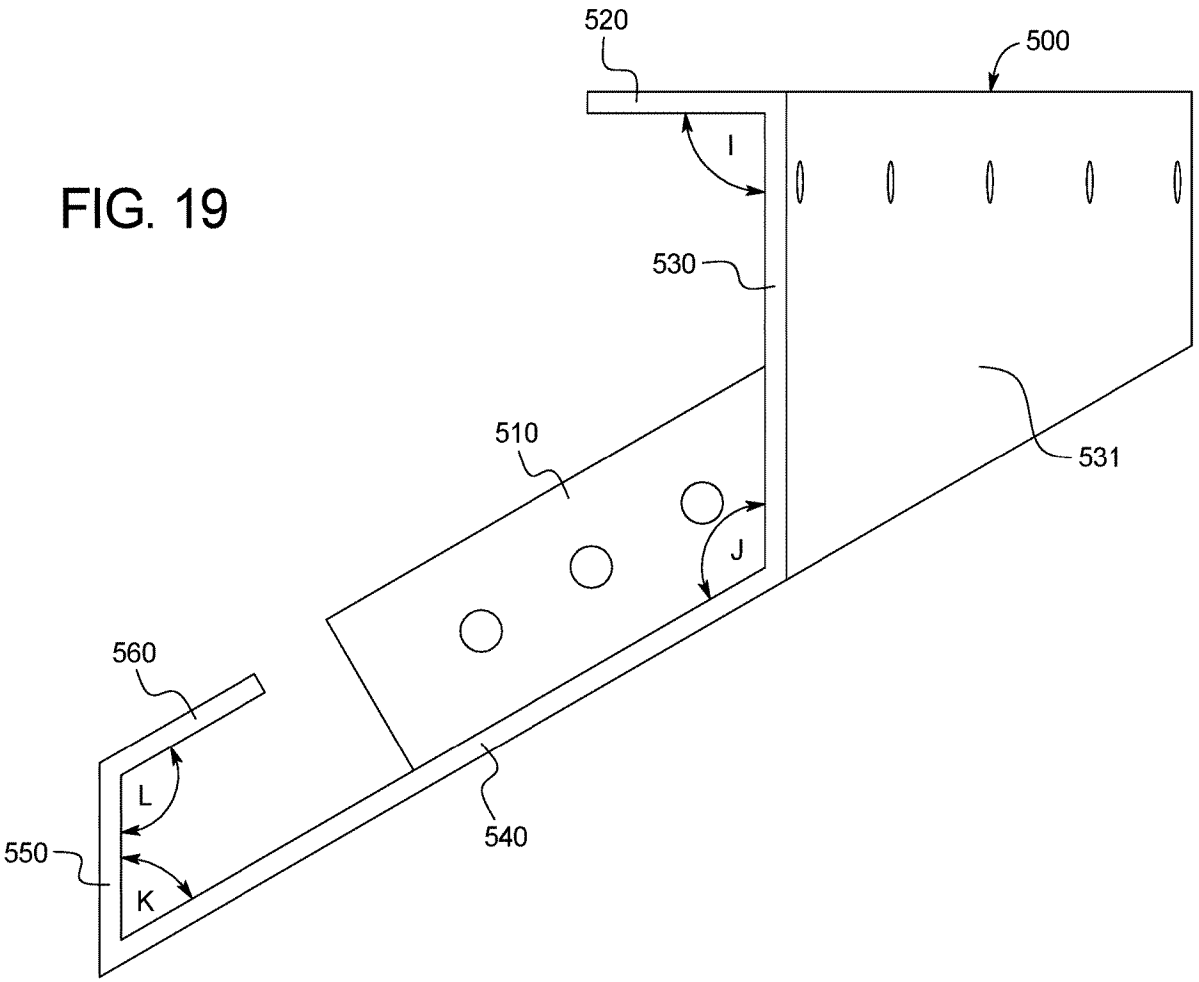
FIG. 19 is an enlarged top view of the end wall of the curb wall forming apparatus of FIG. 3.

The second wall or curb side wall forming panel attachment plate 530 of the end plate 500 includes or defines a plurality of spaced apart openings or holes 539 which enable suitable fasteners (not shown) to be used to attach the curb side wall forming panel 700 to the end plate 500 prior to the pouring of the concrete curb wall 800. The second wall or curb side wall forming panel attachment plate 530 of the end plate 500 extends upwardly at an acute angle A from the plane in which the base plate 510 extends such that the outer surface 531 of second wall or curb side wall forming panel attachment plate 530 extends in a same angled plane as the outer surface 221 of the curb side wall forming panel attachment plate 220 of the floor plate 200, the outer surface 331 of the curb side wall forming panel attachment plate 330 of the curb wall forming panel support 300, and the outer surface 431 of the second wall or curb side wall forming panel attachment plate 430 of the stanchion 400. This enables the curb side wall forming panel 700 to be attached to the second wall or curb side wall forming panel attachment plate 530 of the end plate 500 as generally shown in FIG. 4. It should be appreciated that angle A in FIG. 18 is the same angle as angle A in FIG. 8, angle A in FIG. 11, and angle A in FIG. 14 in this illustrated embodiment. The second wall or curb side wall forming panel attachment plate 530 of the end plate 500 extends at an angle I from the first wall 520 in this illustrated embodiment.

The third wall 540 of the end plate 500 is used to provide an end wall for the curb wall 800. The end plate 500 is positionable such that the third wall 540 extends substantially transverse to the wall 20. The end plate base plate 510 is attached to the third wall 540 in this illustrated embodiment. The third wall 540 of the end plate 500 extends at an angle J from the second wall or curb side wall forming panel attachment plate 530 in this illustrated embodiment.

The end plate 500 is positionable such that the fourth wall 550 of the end plate 500 extends against and substantially parallel to the wall 20. The fourth wall 550 of the end plate 500 extends at an acute angle K from the third wall 540.

The fifth wall 560 of the end plate 500 extends inwardly from the fourth wall 550. The fifth wall 560 of the end plate 500 extends at an obtuse angle L from the fourth wall 540 in this illustrated embodiment. It should be appreciated that angle L could alternatively be a right angle or an acute angle in accordance with the present disclosure. The fifth wall 560 is engageable by the wall attachment or locking plate 600 as generally shown in FIGS. 3, 4, and 6 and as further discussed below.

It should be appreciated that multiple end plates 500 can be used together to form the curb wall and that the quantity of end plates used will depend on the number of separate sections of the desired curb wall(s). The end plates 500 are each made from a metal such as aluminum or steel in this example embodiment. The base plate 510 and the walls 520, 530, 540, 550, and 560 of the end plate 500 are integrally formed from a single sheet of metal in this illustrated embodiment. It should also be appreciated that two or more of these parts can be separately formed and suitably connected. It should be appreciated that the end plates can be made from other suitable materials in accordance with the present disclosure. It should also be appreciated that the end plates can be made having other suitable shapes and sizes in accordance with the present disclosure. It should be appreciated that the holes and the slots in the end plate 500 can be stamped out, drilled out, or otherwise suitably formed.

Figure 20:
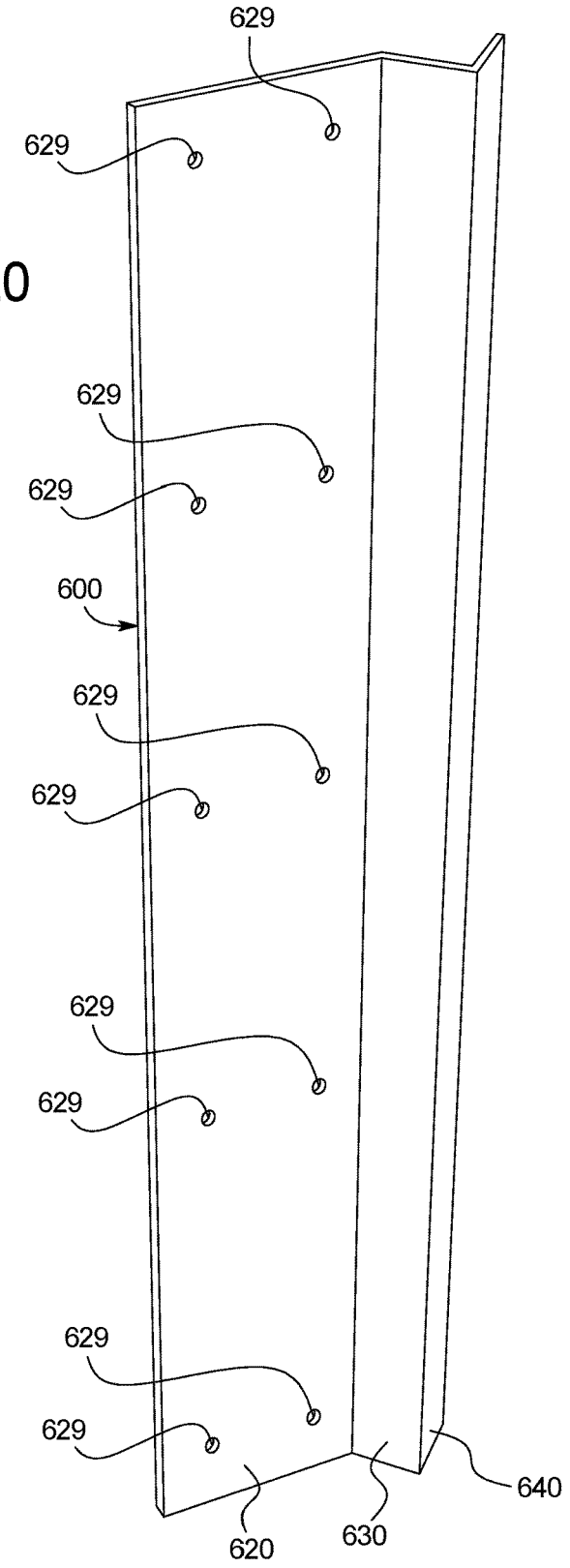
FIG. 20 is an enlarged front perspective view of the wall attachment plate of the curb wall forming apparatus of FIG. 3.
Figure 21:
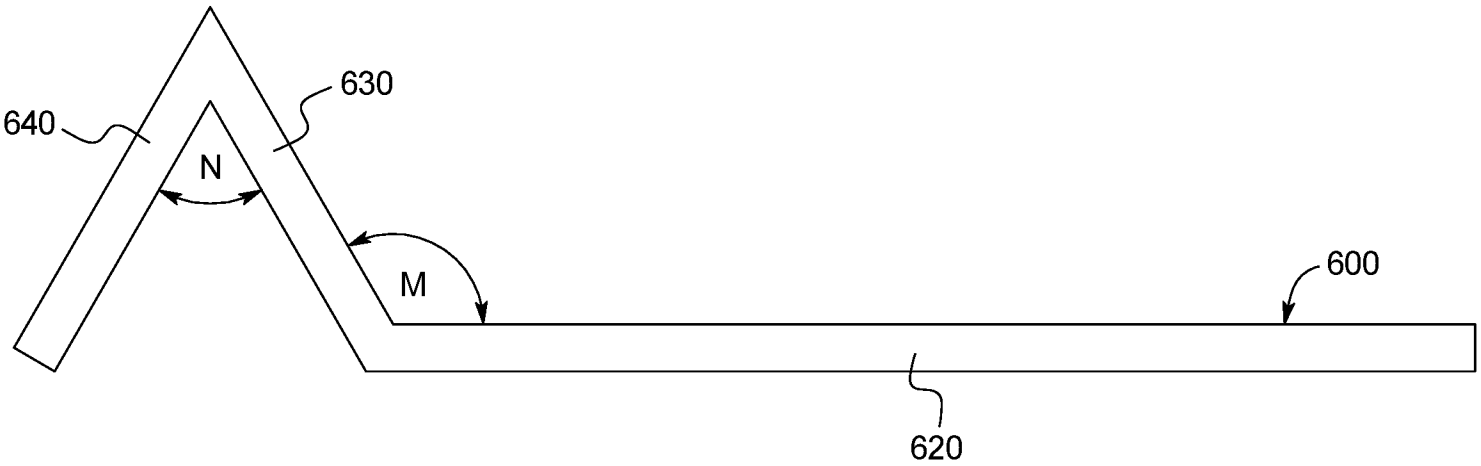
FIG. 21 is an enlarged top view of the wall attachment plate of the curb wall forming apparatus of FIG. 3.

In this illustrated example embodiment, the wall attachment or locking plate 600 generally includes three upwardly extending connected elongated walls and specifically an attachment wall 620, a first locking wall 630, and a second locking wall 640 as generally illustrated in FIGS. 20 and 21. As generally illustrated in FIGS. 3, 4, 5, and 6, each of the wall attachment or locking plates 600 is used to respectively attach one of the stanchions 400 or one of the end plates 500 to the insulated wall 20.

The attachment wall 620 of the wall attachment or locking plate 600 includes or defines therethrough a plurality of spaced apart opening or holes 629 which enable the attachment wall 620 and the wall attachment or locking plate 600 to the wall 20.

The first locking wall 630 of the wall attachment or locking plate 600 extends inwardly from the attachment wall 620, and specifically the first locking wall 630 extends at an obtuse angle M from the attachment wall 620 in this illustrated embodiment.

The second locking wall 640 of the wall attachment or locking plate 600 extends outwardly from the first locking wall 630, and specifically the second locking wall 640 extend at an acute angle N from the first locking wall 630 in this illustrated embodiment.

When the wall attachment or locking plate 600 is used to secure the stanchion 400 as shown in FIGS. 3, 4, and 6, the first locking wall 630 and the second locking wall 640 of the wall attachment or locking plate 600 co-act to engage the fifth wall 460 of the stanchion to secure the stanchion 400 adjacent to the wall 20.

When the wall attachment or locking plate 600 is used to secure the end plate 500 as shown in FIGS. 3, 4, and 6, the first locking wall 630 and the second locking wall 640 of the wall attachment or locking plate 600 co-act to engage the fifth wall 560 of the end plate 500 to secure the end plate 500 adjacent to the wall 20.

It should be appreciated that wall attachment or locking plates 600 are used to attach the stanchions or the end plates to the wall 20 and are thus used together to form the curb wall. It should be appreciated that the quantity of wall attachment plates used will depend on the length of the desired curb wall. The wall attachment plates are each made from a metal such as aluminum or steel in this example embodiment. The three upwardly extending connected walls 620, 630, and 640 are integrally formed from a single sheet of metal in this illustrated embodiment. It should also be appreciated that two or more of these parts can be separately formed and suitably connected. It should be appreciated that the wall attachment plates can be made from other suitable materials in accordance with the present disclosure. It should also be appreciated that the wall attachment plates can be made having other suitable shapes and sizes in accordance with the present disclosure.

It should be appreciated that in various embodiments, one or more suitable mechanisms are used to attach the locking plates to the wall 20. It should also be appreciated that in certain embodiments, a suitable adhesive is used to attach the locking plates to the wall 20. It should be appreciated that in other embodiments, the locking plates are not directly attached to the wall.

In this illustrated example embodiment, the curb side wall forming panel 700 is a substantially flat elongated rectangular panel which is attachable by suitable fasteners (not shown) to the curb side wall forming panel attachment plate 220 of the floor plate 200, the curb side wall forming panel attachment plate 330 of the curb side wall forming panel support 300, the outer or front face 431 of the second wall or curb side wall forming panel attachment plate 430 of the stanchion 400, and the outer or front face 531 of the second wall or curb side wall forming panel attachment plate 530 of the end plate 500 before the concrete of the curb wall 800 is formed as generally shown in FIG. 4 of this illustrated embodiment. After the concrete that forms the curb wall 800 dries and hardens, the curb side wall forming panel 700 is detached from the curb side wall forming panel attachment plate 220, the curb side wall forming panel attachment plate 330, the outer or front face 431, and the outer or front face 531, leaving the floor plate 200, the curb side wall forming panel support 300, the stanchion 400, and the end plate 500, and the wall attachment or locking plate 600 at least partially formed in the curb wall 800.

As best shown in FIG. 5, after the concrete that forms the curb wall 800 dries and hardens and after the curb side wall forming panels are removed, in this illustrated example embodiment, the outer or front face 221 of the curb side wall forming panel attachment plate 220 of the floor plate 200, the outer or front face 331 of the curb side wall forming panel attachment plate 330 of the curb side wall forming panel support 300, the outer or front face 431 of the second wall or curb side wall forming panel attachment plate 430 of the stanchion 400, and the outer or front face 531 of the second wall or curb side wall forming panel attachment plate 530 of the end plate 500 are generally flush with the outer or front face of the curb wall 800.

It should be appreciated that multiple the curb side wall forming panels 700 can be used together to form the curb wall 800 and that the quantity of curb side wall forming panels 700 used will depend in part on the length of the desired curb wall and the length of the curb side wall forming panels 700. The curb side wall forming panels are each made from wood in this illustrated example embodiment. It should be appreciated that the curb side wall forming panels can be made from other suitable materials in accordance with the present disclosure. It should also be appreciated that the curb side wall forming panels can be made having other suitable shapes and sizes in accordance with the present disclosure. It should be appreciated that the curb wall forming panels can be reused.

It should be appreciated from FIGS. 3 and 6 that a plurality of the floor plates 200, a plurality of the curb side wall forming panel supports 300, a plurality of the stanchions 400, a plurality of the end plates 500 (including mirror images there of), and a plurality of the wall attachment or locking plates 600 can be arranged in different manners to accommodate different wall configurations and different curb wall configurations (including spaced apart curb walls or integrally formed curb walls).

It should also be appreciated that the angles mentioned above relate to the illustrated embodiments, and that other embodiments of the present disclosure may include one or more different angles.

It should be appreciated from the above description and from FIGS. 3 to 21 (and specifically FIG. 5) that one of or a plurality of the outer edges of one or more of the walls of the floor plate, the curb side wall forming panel support, the stanchion, the end plate, and the wall attachment plate are in or extend into the concrete curb wall after the curb wall is formed (poured and cured). In other words, these outer edges are not exposed or do not extend from the concrete curb wall It should be appreciated from the above description and FIGS. 3 to 21 (an specifically FIG. 5) that one of or a plurality of the outer edges of one or more of the walls of floor plate, the curb side wall forming panel support, the stanchion, the end plate, and the wall attachment plate lie in the same plane as the outer surface concrete of the curb wall after the curb wall is formed (poured and cured). In other words, these outer edges are not exposed or do not extend from the concrete curb wall.

It should be appreciated from the above description and FIGS. 3 to 21 (an specifically FIG. 5) that one of or a plurality of the outer surfaces of one or more of the walls of the floor plate, the curb side wall forming panel support, the stanchion, the end plate, and the wall attachment plate lie in the same plane as the outer surface concrete of the curb wall after the curb wall is formed (poured and cured). Certain of these outer surfaces form part of or all of certain of the outer surfaces of the curb wall.

The following methods may be employed to form the concrete curb wall:

A method of forming a concrete curb wall on a floor adjacent to a wall extending upwardly from the floor includes:

positioning a floor plate on the floor such that an attachment plate of the floor plate is spaced apart from the wall and extends above the floor;

positioning a curb side wall forming panel support on the floor and such that an attachment plate of the curb side wall forming panel support is spaced apart from the wall;

positioning a first end plate on the floor and facing a first end of the floor plate; positioning a second first end plate on the floor and facing a second end of the floor plate;

attaching a curb side wall forming panel to the attachment plate of the floor plate and to the attachment plate of the curb side wall forming panel support;

pouring concrete in a space at least partially defined by the floor, the wall, the floor plate, the curb side wall forming panel support, the first end plate, the second end plate, and the curb side wall forming panel; and after the concrete has at least partially cured, removing the curb side wall forming panel.

The above method includes positioning the floor plate on the floor such that a lip of the floor plate that is spaced apart from the wall extends: (i) above the floor; and (ii) toward the wall into the space where the concrete curb wall will be formed.

The method includes positioning the floor plate on the floor such that a lip of the floor plate that is spaced apart from the wall extends: (i) above the floor; (ii) toward the wall into the space where the concrete curb wall will be formed; and (iii) such that the poured concrete will flow though the lip of the floor plate.

Another similar method of forming a concrete curb wall on a floor adjacent to a wall extending upwardly from the floor includes the following:

positioning a floor plate on the floor such that an attachment plate of the floor plate is spaced apart from the wall and extends above the floor;

positioning a curb side wall forming panel support on the floor and such that an attachment plate of the curb side wall forming panel support is spaced apart from the wall;

positioning a first stanchion on the floor and facing a first end of the floor plate; positioning a second stanchion on the floor and facing a second end of the floor plate;

attaching a curb side wall forming panel to the attachment plate of the floor plate and to the attachment plate of the curb side wall forming panel support;

pouring concrete in a space at least partially defined by the floor, the wall, the floor plate, the curb side wall forming panel support, the first stanchion, the second stanchion, and the curb side wall forming panel; and after the concrete has at least partially cured, removing the curb side wall forming panel.

The above method includes positioning the floor plate on the floor such that a lip of the floor plate that is spaced apart from the wall extends: (i) above the floor; and (ii) toward the wall into the space where the concrete curb wall will be formed.

The above method includes positioning the floor plate on the floor such that a lip of the floor plate that is spaced apart from the wall extends: (i) above the floor; (ii) toward the wall into the space where the concrete curb wall will be formed; and (iii) such that the poured concrete will flow though the lip of the floor plate.

Another similar but alternatively stated method of forming a concrete curb wall on a floor adjacent to a wall extending upwardly from the floor includes the following:

forming a concrete curb wall on a floor adjacent to a wall extending upwardly from the floor, said method includes:

positioning a floor plate on the floor such that an attachment plate of the floor plate is spaced apart from the wall and extends above the floor;

positioning a curb side wall forming panel support on the floor and such that an attachment plate of the curb side wall forming panel support is spaced apart from the wall;

positioning an end plate on the floor and facing a first end of the floor plate; positioning a stanchion on the floor and facing a second end of the floor plate; attaching a curb side wall forming panel to the attachment plate of the floor plate and to the attachment plate of the curb side wall forming panel support;

pouring concrete in a space at least partially defined by the floor, the wall, the floor plate, the curb side wall forming panel support, the end plate, the stanchion, and the curb side wall forming panel; and after the concrete has at least partially cured, removing the curb side wall forming panel.

The above method includes positioning the floor plate on the floor such that a lip of the floor plate that is spaced apart from the wall extends: (i) above the floor; and (ii) toward the wall into the space where the concrete curb wall will be formed.

The above method further includes positioning the floor plate on the floor such that a lip of the floor plate that is spaced apart from the wall extends: (i) above the floor; (ii) toward the wall into the space where the concrete curb wall will be formed; and (iii) such that the poured concrete will flow though the lip of the floor plate.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of forming a concrete curb wall on a floor adjacent to a wall extending upwardly from the floor, said method comprising:

positioning a floor plate on the floor such that an attachment plate of the floor plate is spaced apart from the wall and extends above the floor;

positioning a curb side wall forming panel support on the floor and such that an attachment plate of the curb side wall forming panel support is spaced apart from the wall;

positioning a first end plate on the floor and facing a first end of the floor plate;

positioning a second first end plate on the floor and facing a second end of the floor plate;

attaching a curb side wall forming panel to the attachment plate of the floor plate and to the attachment plate of the curb side wall forming panel support;

pouring concrete in a space at least partially defined by the floor, the wall, the floor plate, the curb side wall forming panel support, the first end plate, the second end plate, and the curb side wall forming panel; and after the concrete has at least partially cured, removing the curb side wall forming panel.

2. The method of claim 1, which includes positioning the floor plate on the floor such that a lip of the floor plate that is spaced apart from the wall extends: (i) above the floor; and (ii) toward the wall into the space where the concrete curb wall will be formed.

3. The method of claim 1, which includes positioning the floor plate on the floor such that a lip of the floor plate that is spaced apart from the wall extends: (i) above the floor; (ii) toward the wall into the space where the concrete curb wall will be formed; and (iii) such that the poured concrete will flow though the lip of the floor plate.

4. A method of forming a concrete curb wall on a floor adjacent to a wall extending upwardly from the floor, said method comprising:

positioning a floor plate on the floor such that an attachment plate of the floor plate is spaced apart from the wall and extends above the floor;

positioning a curb side wall forming panel support on the floor and such that an attachment plate of the curb side wall forming panel support is spaced apart from the wall;

positioning a first stanchion on the floor and facing a first end of the floor plate;

positioning a second stanchion on the floor and facing a second end of the floor plate;

attaching a curb side wall forming panel to the attachment plate of the floor plate and to the attachment plate of the curb side wall forming panel support;

pouring concrete in a space at least partially defined by the floor, the wall, the floor plate, the curb side wall forming panel support, the first stanchion, the second stanchion, and the curb side wall forming panel; and after the concrete has at least partially cured, removing the curb side wall forming panel.

5. The method of claim 4, which includes positioning the floor plate on the floor such that a lip of the floor plate that is spaced apart from the wall extends: (i) above the floor; and (ii) toward the wall into the space where the concrete curb wall will be formed.

6. The method of claim 4, which includes positioning the floor plate on the floor such that a lip of the floor plate that is spaced apart from the wall extends: (i) above the floor; (ii) toward the wall into the space where the concrete curb wall will be formed; and (iii) such that the poured concrete will flow though the lip of the floor plate.

7. A method of forming a concrete curb wall on a floor adjacent to a wall extending upwardly from the floor, said method comprising:

positioning a floor plate on the floor such that an attachment plate of the floor plate is spaced apart from the wall and extends above the floor;

positioning a curb side wall forming panel support on the floor and such that an attachment plate of the curb side wall forming panel support is spaced apart from the wall;

positioning an end plate on the floor and facing a first end of the floor plate;

positioning a stanchion on the floor and facing a second end of the floor plate;

attaching a curb side wall forming panel to the attachment plate of the floor plate and to the attachment plate of the curb side wall forming panel support;

pouring concrete in a space at least partially defined by the floor, the wall, the floor plate, the curb side wall forming panel support, the end plate, the stanchion, and the curb side wall forming panel; and after the concrete has at least partially cured, removing the curb side wall forming panel.

8. The method of claim 7, which includes positioning the floor plate on the floor such that a lip of the floor plate that is spaced apart from the wall extends: (i) above the floor; and (ii) toward the wall into the space where the concrete curb wall will be formed.

9. The method of claim 7, which includes positioning the floor plate on the floor such that a lip of the floor plate that is spaced apart from the wall extends: (i) above the floor; (ii) toward the wall into the space where the concrete curb wall will be formed; and (iii) such that the poured concrete will flow though the lip of the floor plate.

* * * * *